US009540875B2

(12) United States Patent
Ellis

(10) Patent No.: US 9,540,875 B2
(45) Date of Patent: Jan. 10, 2017

(54) SAFETY DEVICE FOR LADDERS

(71) Applicant: J. Nigel Ellis, Wilmington, DE (US)

(72) Inventor: J. Nigel Ellis, Wilmington, DE (US)

( * ) Notice: Subject to any disclaimer, the term of this patent is extended or adjusted under 35 U.S.C. 154(b) by 0 days.

(21) Appl. No.: 14/604,050

(22) Filed: Jan. 23, 2015

(65) Prior Publication Data

US 2016/0215563 A1 Jul. 28, 2016

(51) Int. Cl.

| | |
|---|---|
| ***E06C 7/42*** | (2006.01) |
| ***E06C 7/18*** | (2006.01) |
| ***E06C 7/48*** | (2006.01) |
| ***E06C 1/04*** | (2006.01) |
| *E06C 7/50* | (2006.01) |

(52) U.S. Cl.

CPC ..... *E06C 7/182* (2013.01); *E06C 1/04* (2013.01); *E06C 7/183* (2013.01); *E06C 7/48* (2013.01); *E06C 7/50* (2013.01)

(58) Field of Classification Search

CPC ..... E06C 7/181; E06C 7/182; E06C 7/50; E06C 7/00; E06C 7/083; E06C 7/087

See application file for complete search history.

(56) References Cited

U.S. PATENT DOCUMENTS 2,815,160 A * 12/1957 Gilmour ..... E06C 1/345 182/107
2,881,028 A * 4/1959 Baird ..... E06C 7/16 182/113
3,899,045 A * 8/1975 Geisel ..... E06C 7/16 182/121
4,060,150 A * 11/1977 Hughes ..... E06C 1/10 182/151
4,303,145 A * 12/1981 Vazquez ..... E06C 7/183 182/106
4,469,193 A * 9/1984 Rumsey, Jr. ..... E06C 7/42 182/107
4,580,660 A * 4/1986 Oling ..... E06C 7/48 182/107
4,600,079 A * 7/1986 McBride ..... E06C 7/48 182/108
5,033,582 A * 7/1991 Hoben ..... B60R 3/02 182/106
5,117,941 A * 6/1992 Gruber ..... E06C 7/484 182/107
5,222,575 A * 6/1993 Santos ..... E06C 7/44 182/108
5,261,507 A * 11/1993 Williams ..... E06C 7/48 182/214

(Continued)

*Primary Examiner* — Daniel Cahn
(74) *Attorney, Agent, or Firm* — Paul & Paul

(57) ABSTRACT

Walk-through safety devices for ladders meeting ANSI and OSHA standards are positioned at the top end of the ladder and are comprised of two, juxtapose-position, mirror image members. One each is mounted on a respective ladder side rail, Each member includes a sleeve (or rectangular tube) which slides down over a respective ladder side rail, a pressure bar which is tightened against the side rail with a knob operated screw, a pivoting engaging lock plate, and a lock plate tab cover plate. A horizontal hand grip framework is held outboard of the ladder side rails vertically upward, being at an angle of about 14.5 degrees upward from the longitudinal axis of the sleeve and side rail when resting against a structure. The framework is held in that position by a flared tube which is bent in two directions.

4 Claims, 13 Drawing Sheets

(56) References Cited

U.S. PATENT DOCUMENTS 5,743,356 A * 4/1998 Mitchell ..... E06C 7/48 182/107
5,855,252 A * 1/1999 Vrolyks ..... E06C 7/48 182/107
5,941,343 A * 8/1999 Kelsey ..... E06C 7/182 182/107
6,095,283 A * 8/2000 Ellis ..... E06C 1/38 182/106
6,347,685 B1 * 2/2002 Ellis ..... B60R 3/005 182/106
6,394,229 B1 5/2002 Hastreiter
6,422,341 B1 * 7/2002 Engdahl ..... E06C 7/16 182/103
6,837,338 B2 * 1/2005 Grover ..... E06C 7/48 182/107
D537,958 S * 3/2007 Clark ..... D25/68
7,556,125 B1 * 7/2009 Blehm ..... E06C 7/488 182/107
7,913,964 B1 * 3/2011 Kennedy ..... E06C 7/14 248/210
8,136,632 B2 3/2012 Gabriel
8,439,163 B2 5/2013 Inman
8,839,908 B2 * 9/2014 Davis, Jr. ..... E06C 7/188 182/106
2002/0079166 A1 * 6/2002 Gaik ..... E06C 7/06 182/211
2003/0221910 A1 * 12/2003 Huang ..... E06C 1/18 182/163
2004/0079584 A1 * 4/2004 Blythe ..... B63B 27/146 182/82
2005/0023084 A1 * 2/2005 Lazarus ..... E06C 7/48 182/214
2005/0236227 A1 * 10/2005 Clark ..... E06C 7/182 182/106
2008/0190692 A1 * 8/2008 Feik ..... E06C 7/182 182/107
2008/0202850 A1 * 8/2008 Anderson ..... B60R 3/007 182/106
2008/0251316 A1 * 10/2008 Libert ..... E04G 5/10 182/115
2010/0096215 A1 * 4/2010 McFarlane ..... B60R 3/007 182/106
2010/0300805 A1 * 12/2010 Moss ..... E06C 1/12 182/18
2011/0247895 A1 * 10/2011 Smith ..... E06C 7/165 182/106
2015/0075905 A1 * 3/2015 Ballard ..... E06C 1/36 182/107

* cited by examiner

SAFETY DEVICE FOR LADDERS

BACKGROUND OF THE INVENTION

1. Field of the Invention

The present invention relates to safety devices for the upper ends of ladders.

2. Brief Description of the Prior Art

Accidents involving ladders, such as both portable extension ladders and non-extension ladders, can occur when the ladder shifts either because the climber is off balance to one side of the ladder, or because the climber accidentally moves the ladder when climbing off or onto a roof. The most dangerous time when using a ladder to descend is when stepping off of a roof onto a rung of the ladder. The climber is precariously perched, and must cautiously move himself with one foot on the roof and the other on the ladder before bringing the other foot onto the ladder. Standard portable ladders extend above the roof line and the climber must swing step around the extension to exit the ladder.

Additionally, a climber may lose a hand grip or his foot may slip off of a rung, or his foot may engage another object while climbing any of which may result in the climber falling, Ladder falls generally result in serious injury, and often result in death or paralysis.

Various solutions have been proposed to make the ladder more stable and ladder climbing safer. Inman, U.S. Pat. No. 8,439,163, fixes a ladder shoe to extend away from the ladder to engage a gutter. This shoe extends outwardly from the ladder. It limits how far the extension ladder can be collapsed, and also makes stacking the ladder more difficult for storage. Hastreiter, U.S. Pat. No. 6,394,229, proposes curved pole extensions bolted to each side rail of the ladder with a series of clamps. The distal end of each pole has a foot resting on the roof surface. These pole extensions must be carefully mounted on the outside of the ladder side rails each time the ladder is used. Otherwise the ladder is very cumbersome to move about or store.

The clamping required by Hastreiter is time consuming to install. While the pole extensions permit a walk-through climbing on and off the ladder, they are also intended to keep the ladder rails from contacting a gutter. This creates a space between the side rails of the ladder and the roof or roof gutter. In so doing, the pole extensions must bear the entire weight of the climber at an obtuse angle which requires them to be strong enough to hold against the bending forces thereby increasing their cost. Also, such pole extensions generally reduce the load capacity of the ladder.

Gabriel, U.S. Pat. No. 8,136,632, creates a step through extension ladder with a collapsible platform at its upper end. The platform collapses into a rung-free area at the upper end of the ladder side rails. When extended, this platform rests on the pitch of a roof with the ladder side rails resting against the roof edge or gutter. This requires a custom ladder re-configuration.

It is has long been suggested for safety, a ladder when leaning against a building or platform, is to be at an angle of about 75 degrees from horizontal. This means that the ladder side rails of each of the above ladders are pitched at an angle of about 15 degrees from vertical when above the roof or platform. This pitch makes climbing back from the roof onto the ladder safer. A steep pitch may promote fall back. A lesser pitch may produce slide out or "pancaking."

Ellis, U.S. Pat. No. 6,095,283, shows a vertically upright ladder, permanently attached to a building, with a walk-through design having a wider ladder profile in the walk-through section at the top of the ladder. Two box-shaped elongate sleeves slide down over the top ends of the ladder side rails which side rails, are flared outward to widen the opening between side rails sufficiently to accommodate a climber and a plurality of inwardly extending horizontal grab rungs. The sleeves are positioned above the side rail flaring and secured to the side rails once in position. The location of the top of the sleeves is proximate to the top of the ladder side rails. The permanently flared outward side rails create an awkward structure for moving about and when storing the ladder.

Ellis, U.S. Pat. No. 6,347,685, shows a vertically upright ladder for permanent attachment to a structure with a walk-through area having two handhold cages providing recommended horizontal grab bars secured permanently to the top end of a respective ladder side rail. For ladders with flared out side rails, the grab cage is attached to the inside face of each side rail. For straight rails, the grab cage is attached to the outside face of each side rail.

Walk-through ladders have the advantage of providing a safer transition for the climber from the ladder to a roof and from a roof to the ladder. Permanently attached vertical walk-through ladders as shown by Ellis provide a safer transition region for the climber. The climber can first grasp one of the grab bars within box-like frameworks while safely standing on the roof. He can then turn and additionally grasp the second cage. While safely gripping both cages he can step onto the first ladder rung and then begin to transfer his hands to the grab bars.

OSHA regulations require that the base of an extension ladder, which OSHA considers as a portable ladder, be positioned away from the structure against which the extension ladder rests at a distance of about one-fourth of the working length of the ladder. That equates to about an angle of 75.5 degrees from the horizontal. OSHA regulations also state that no ladder should be used to gain access to a roof unless the top of the ladder shall extend at least three feet above the point of support. OSHA also wants each climber to face the ladder the entire ladder distance when climbing up or descending down, and to maintain a three-point control (two hands and a foot or two feet and a hand) resulting from holding rungs horizontally is much stronger and safer than holding side rails where a climber's hand can slide when on a ladder.

Because of the walk-through configuration at the top of the ladder, walk-through ladders are difficult to store and difficult to stack for travel on a vehicle. It is therefore desirable to provide a walk-through configuration at the top end of an extension ladder which is easily removable when the ladder is to be stored or stacked.

As safety is the first concern, it is desirable to provide a removable walk-through structure for a ladder which can be securely attached to the ladder upper end when the ladder is in use, and is easily removed when the ladder is to be stored or stacked for travel on a vehicle, or moved about.

It is also desirable that this structure is embodied in a safety device which can be easily attached to and removed from a standard ladder, such as a standard extension ladder.

Additionally, it is desirable to provide such a walk-through safety device which does not require any modification of a standard extension ladder, albeit, the walk-through safety device will be sized for the size of the ladder side rails which can vary with the materials from which the ladder is made, e.g., steel, aluminum or fiberglass, and in some cases wood, and for a specific ladder length and capacity ladder.

It is also desirable to have the walk-through safety device include a grab bar (handhold) cage, which will not interfere with the movement of a climber, and where the orientation of the safety grab (handhold) cage is upright and the handholds are horizontally oriented at the recommended spacing, when the ladder properly rests against a structure. The horizontal rung hand hold is intuitive for most climbers to grip and hold successfully in a dynamic fall. A fall become "dynamic" once a body is in motion. Once a fall has begun, grabbing a portion of a ladder results in forces on the hands which are increased greatly, making arrest difficult. If the handhold (rung) is horizontal, sliding is avoided.

SUMMARY OF THE INVENTION

The objectives of the invention are realized in a removable walk-through safety device for the top of conventional design portable ladders including both extension ladders and straight (non-extension) ladders. The safety device has two complementary shaped members mountable on respective ladder side rails. These paired members provide horizontal grab bars (handholds) in a framework positioned outboard of the ladder side rails and canted upward to the vertical when the ladder rests against a structure or wall at the recommended OSHA angle of the main ladder (75.5 degrees).

Research has shown that in climbing ladders, it is important to hold horizontal grab surfaces like round rungs and not vertical surfaces. The transfer between a roof and a standard extension ladder is a dangerous task as there is no good way to side step off of a ladder and onto a roof and back which requires walking around the ladder side rails when the OSHA requirement for 30 inch extension is met. The present invention permits a climber to step through the top section of ladder which presents a clear passageway for the climber to move onto a roof and back. It converts a standard extension ladder or other ladder to enable step through instead of step-around movements, which can be destabilizing for the climber.

The pair of removable walk-through ladder members fit over the top end of the side rails of a commercially available extension ladder. The shapes of these members are mirror images of each other, with the paired members being positioned, one each, juxtaposed at the top end of each respective side rail of the ladder.

Each member preferably includes a box-shaped sleeve (rectangular tube) with an open lower end and a flat wall closing off the top end. Each sleeve's cross-section is preferably sized slightly larger than the side rail cross-section of an extension ladder to permit it to slide over the respective side rail while limiting the amount of play there between. In conformance with the shape of the side rail of a conventional ladder, each sleeve preferably has two opposing wider sidewalls and two opposing narrower sidewalls, Each sleeve is preferably sized in length to extend over the top rung and to terminate at the position proximate the second rung.

Preferably, the distance between the members when mounted on a ladder is from about 23 to 26 inches, permitting a person to easily walk through the safety device while maintain a firm grasp on the safety device.

A longitudinal slot preferably extends along the inside wider sidewall of each sleeve from its open bottom. The slot preferably has a top which rests against the top rung of the ladder when the safety device is installed, and preferably conforms to the shape of the rung. The outside wider sidewall of each sleeve preferably has a cutout opening which provides a clearance for the outward projection of the second rung beyond the outside face of the rail. The cutout preferably conforms to the shape of the second rung, such as a semi-circular cut out for a rung having a circular cross-section.

A tubular support post is preferably welded to the outside face of each sleeve to flair outwardly and then upwardly from the longitudinal axis of a sleeve at an angle of about 15 degrees, preferably, 14.5 degrees. Preferably, attached to this tubular post is a series of tubular handles, such as a series of three handles, which are used as climber grab bars (handholds) by a climber, and which extend outwardly perpendicularly to the plane of the outside face of the sleeve. Attached to the outside end of each tubular handle (handhold) is a support bar which with the grab bars and the tubular post form a handhold framework. When the ladder rests against a structure at the recommended OSHA safety angle, each handhold framework extends vertically, is outboard of, and is perpendicular to, each rail.

The three grab bars (handholds) are preferably spaced on 12 inch centers and preferably no more apart than 14 inches. The tubular sleeve, support post and handhold frameworks are sized so that the top grab bar (handhold) is about three-feet above the rest point of the ladder against the structure or wall and the handhold framework extends vertically when the ladder is properly rested against a structure, It is noteworthy that about one-half of OSHA's ladder citations are based on a failure to extend three feet over a dismount level or platform.

Each of the two sleeves is preferably securely mounted on a side rail with the sleeve sidewall elongate slot resting on the top rung of the ladder. A clamping pressure is preferably exerted between the sleeve and the adjacent face of the side rail. This clamping pressure is preferably obtained with a securing tab plate being forced against the side rail by a knob operated screw, whereby the securing tab plate is preferably moved with a clamping force against the side rail. This securing tab plate is preferably implemented as an elongate rectangular flat bar with an end box-shaped rectangular shoe. The shoe is preferably forced into a mating opening in the smaller sidewall of the sleeve where it is securely held in a friction fit.

A triangularly shaped plate preferably acts as a rung engaging pivot lock. This pivot lock is preferably attached to the inside wider face of the sleeve to pivot out of the way when the sleeve slides past the top rung, and to return to its original position when it has passed the top rung. In its original position the lock plate preferably extends to an orientation in which it would engage the bottom surface of the top rung if the sleeve moved upwardly. In this original interference position, the pivot lock preferably prohibits the removal of the sleeve from the ladder as it engages the top rung to prohibit further upward movement of the sleeve off of the side rail.

The pivot lock plate preferably has two tabs. The first tab (the locking tab) preferably extends perpendicular to the plane of the plate across the smaller face of the sleeve. A tempered spring plate is preferably attached to the inside face of the sleeve to engage the lock plate perpendicular tab to spring bias the lock plate into the original position. The second tab preferably extends upwardly in the plane of the plate. This second tab is preferably used to manually pivot the lock plate from an interference engagement with the ladder top rung when the sleeve is to be removed from the side rail. A triangular side-profiled locking tab cover plate preferably covers the locking tab and spring plate movement and to protect these structures from damage by repeated climbers.

The labeled safety device left-hand and right-hand members are preferably easily assembled on the side rail ends of a conventional straight or extension ladder and easily removed. The knob operated screw is preferably tightened to remove the slackness when the ladder is in use.

DETAILED DESCRIPTION

The features, advantages and operation of the present invention will become readily apparent and further understood from a reading of this detailed description with the accompanying drawings, in which like numerals refer to like elements, and in which:

In one presently preferred embodiment the present invention provides a safety device preferably to be mounted onto the top or distal end of an extension ladder, such as a conventional extension ladder, to add a walk-through configuration having handhold grab framework to the ladder extending vertically above the extension ladder, preferably at the OSHA-recommended distance. The safety device 23 of the present invention can be used with conventional fixed (non-extendable) ladders, conventional extension ladders, articulated (collapsible) ladders, fire rescue ladders, etc.

The safety device 23 is preferably formed from a high strength material, such as steel or aluminum, and more preferably, a high strength light weight material such as aluminum.

Figure 1:
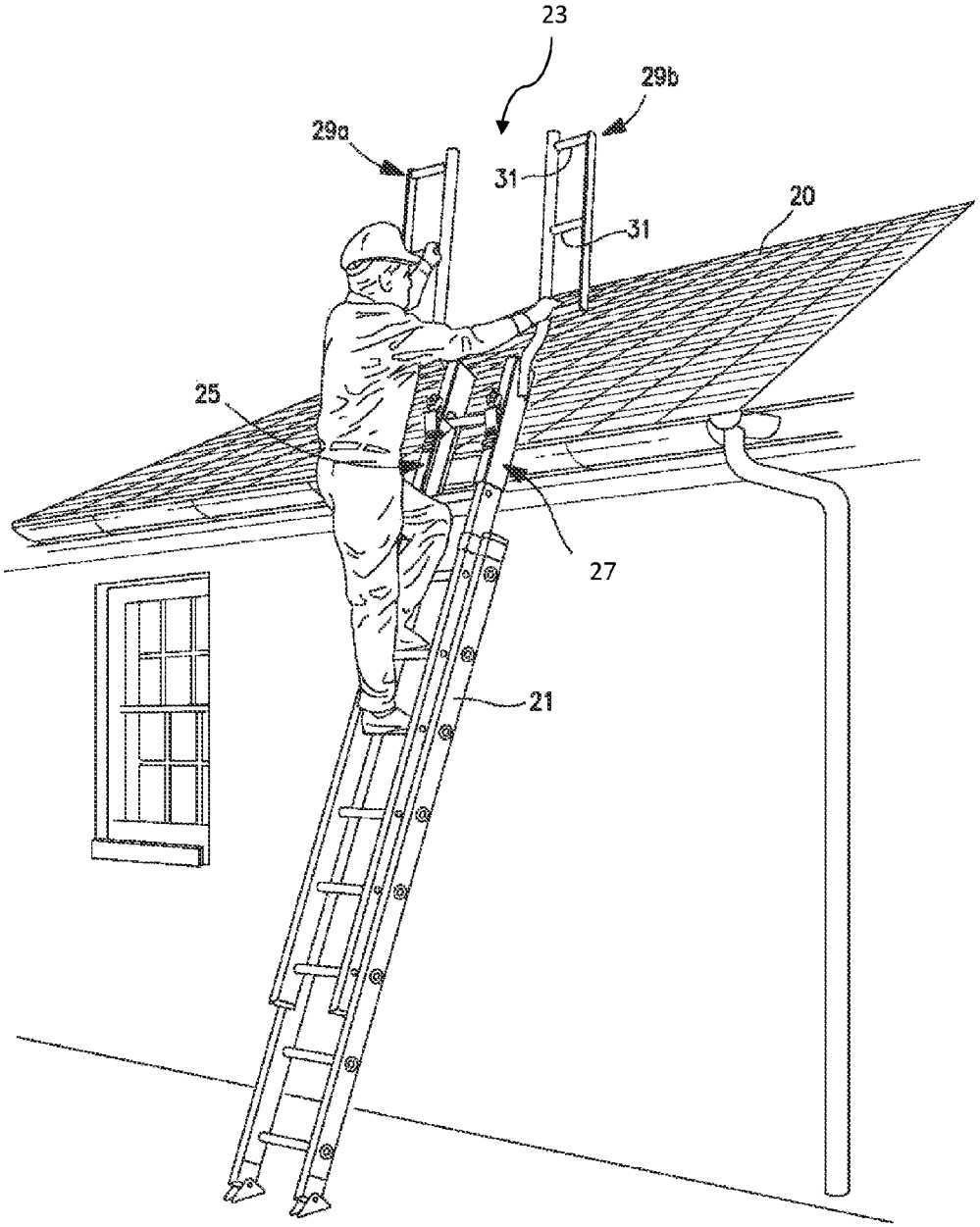
FIG. 1 is perspective view of a conventional extension ladder, with the safety device of the present invention having two members installed, the ladder resting against a structure with a climber about to step upon a roof.

As can be seen in the perspective view of FIG. 1, an extension ladder 21 rests against a building 20 at the OSHA-recommended angle of 75.5 degrees and is being climbed by a user about to climb upon the roof of the building 20. A safety device 23 is fitted to the top end of the extension ladder 21.

Advantageously, it is the top end of the extension ladder 21 that contacts the surface of the surface of the wall or building 20 against which the ladder 21 bears (although the top ends of the sides of the ladder may be covered by a portion of the safety device as shown below). Thus, no force is being transmitted through the upwardly extending portions of the safety device when a ladder 21 fitted with the safety adapter 23 is positioned against the building 20.

The safety device 23 preferably includes both a left-hand member 25 and a right-hand member 27. The left-hand member 25 and the right-hand member 27 are mirror images of each other. Each of the members 25, 27 includes a respective handhold framework 29*a*, 29*b*. In this embodiment, each handhold framework 29*a*, 29*b* has three successive horizontally extending handhold bars 31, preferably spaced by about 12 inches from each adjacent bar 31. Preferably, the diameter of each bar 31 is about one inch to one and one-half inches (runglets) such that the bars can be easily grasped by a person climbing the ladder, and which helps avoid falling. Each of the handhold bars 31 extend from an inward support pole 45 to a corresponding outward support bar 47. The inward support pole 45 and the outward support bar 47 are preferably parallel to one another, and the inward support pole 45, handhold bars 31, and outward support bar 47 of each of the handhold frameworks 29*a*, 29*b* preferably all lie in the same plane, which extends vertically above the extension ladder 21.

Figure 7:
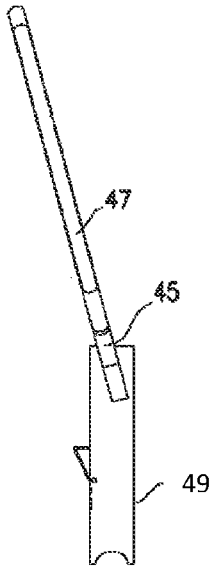
FIG. 7 is a left side view of the sleeve and handhold framework of the right-hand member of the present invention.

Each of the support poles 45 has an inward facing surface and an outward facing surface. A pad 43 (FIG. 2*b*, FIG. 7) formed from a slip-resistant material is secured, such as by an adhesive material, to the inward facing surface of each of the support poles 45, such that when the safety device 23 is mounted on a ladder 21 and the ladder 21 is positioned against a building or wall the slip-resistant pad 43 contacts the surface of the building or wall to help prevent slippage of the ladder 21 in a direction perpendicular to the ladder 21. Examples of suitable slip-resistant materials include natural rubber and synthetic elastomers.

Figure 2:
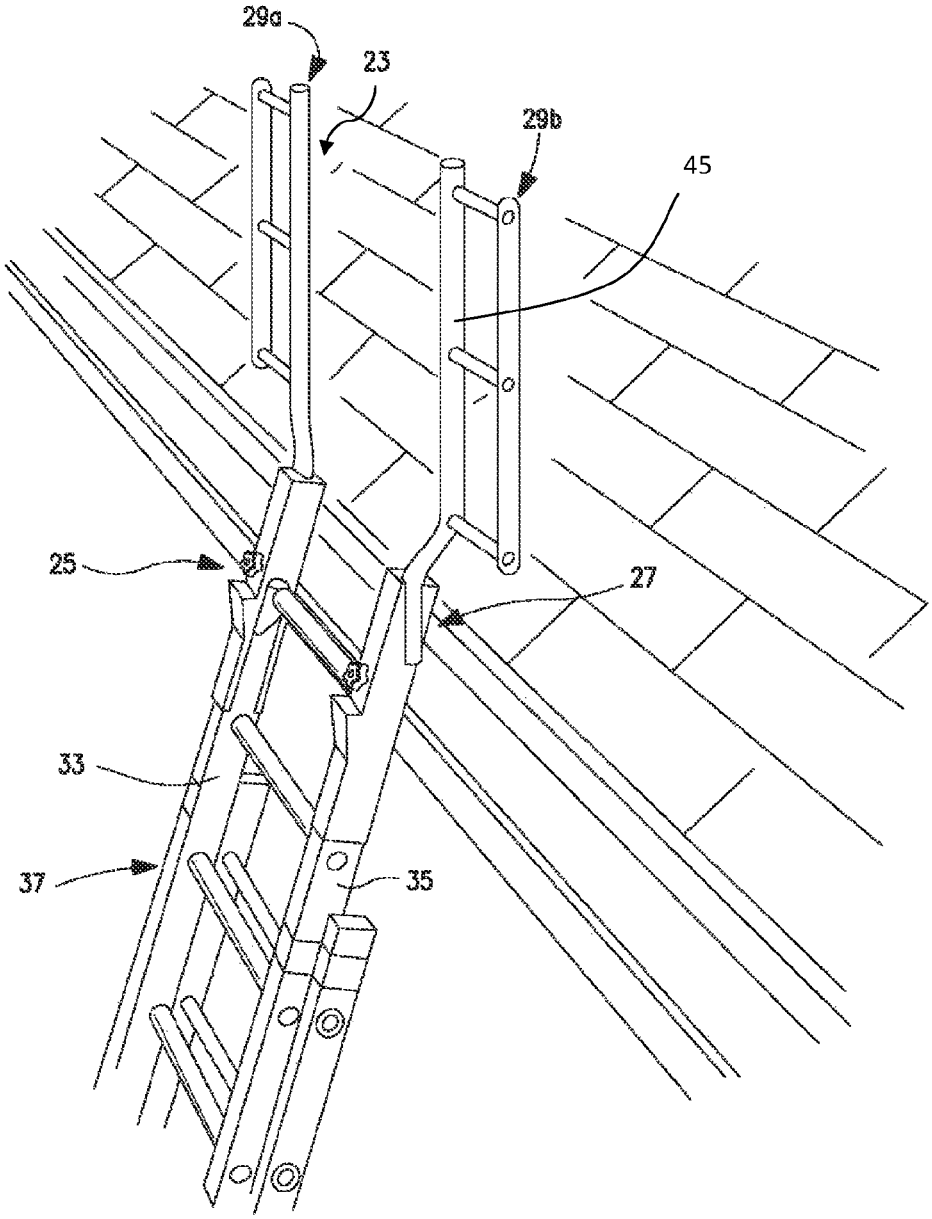
FIG. 2 is a partial perspective view of the extension ladder of FIG. 1 showing the left hand and right hand members of the safety device.
Figure 20:
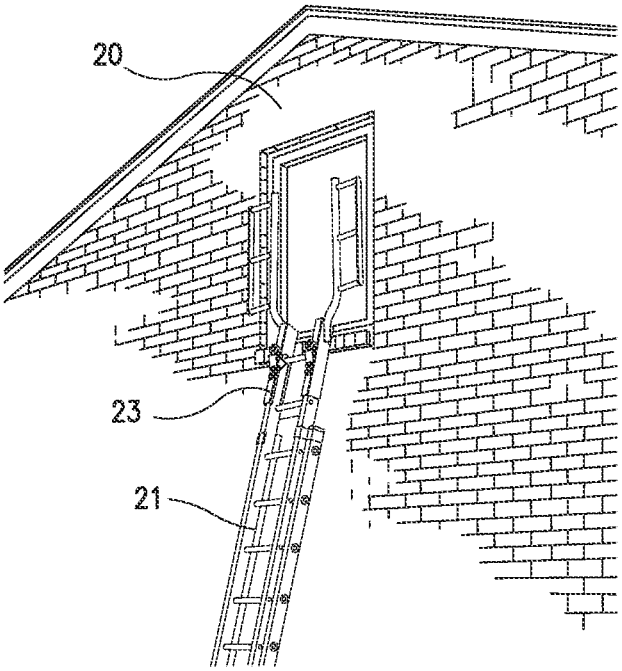
FIG. 20 is a perspective view of the ladder and safety device of FIG. 1 showing the ladder and safety device positioned against a building wall to permit access to a window in the wall for window maintenance or repair.

As best seen in the perspective view of FIG. 2, the left-hand member 25 and the right-hand member 27 are each mounted to a respective left side rail 33 and right side rail 35 of the upper section 37 of the extension ladder 21. When the extension ladder 21 is positioned at a predetermined leaning angle, such as the OSHA-recommended leaning angle, where the distance from the wall to the base of the ladder is a distance which is 25 percent of the working length of the ladder, the frameworks 29*a*, 29*b* extend approximately vertically, preferably for a predetermined distance, such as the recommended distance of about three feet, above the resting point of the ladder, In the present specification and claims, "vertical" means extending upward approximately 90 degrees from horizontal, but can vary plus or minus 10 degrees therefrom depending on conditions. The two support poles 45 and the uppermost rung of the ladder collectively form an opening or window 46 though which the climber can pass though onto a roof or other surface when the ladder 21 and safety device 23 are positioned such that the safety device 23 extends above the roof or other surface. Further, when ladder 21 with the safety device 23 mounted thereon are positioned against a wall or other vertical surface, the two support poles 45 and the uppermost rung of the ladder 21 frame a window 46 on the surface in which a climber can safely perform work, such as maintenance tasks including painting the surface of a window or other architectural feature provided on the surface, such as depicted in FIG. 20. The ladder 21 with the safety device 23 can be centrally positioned on the window permitting a climber to work without the destabilizing leaning that can occur when using most other ladders and ladder extensions. Preferably, the safety device 23 and ladder 21 are positioned such that there is a least about an inch of clearance between the safety device 23 and the wall or window frame for gripping the safety device.

Depending on the configuration of the ladder sides, the support poles 45 may be canted in the plane of the ladder to provide the frameworks with the desired vertical extension. For example, when the upper ends of the ladder sides are flared outwardly, the support poles may be canted or bent inwardly such that the outward support bars extend vertically and the grab bars extend horizontally (not shown). Similarly, when the upper ends of the ladder sides are flared inwardly, the support poles may be canted or bent outwardly such that the outward support bars extend vertically and the grab bars extend horizontally (not shown).

Figure 2A:
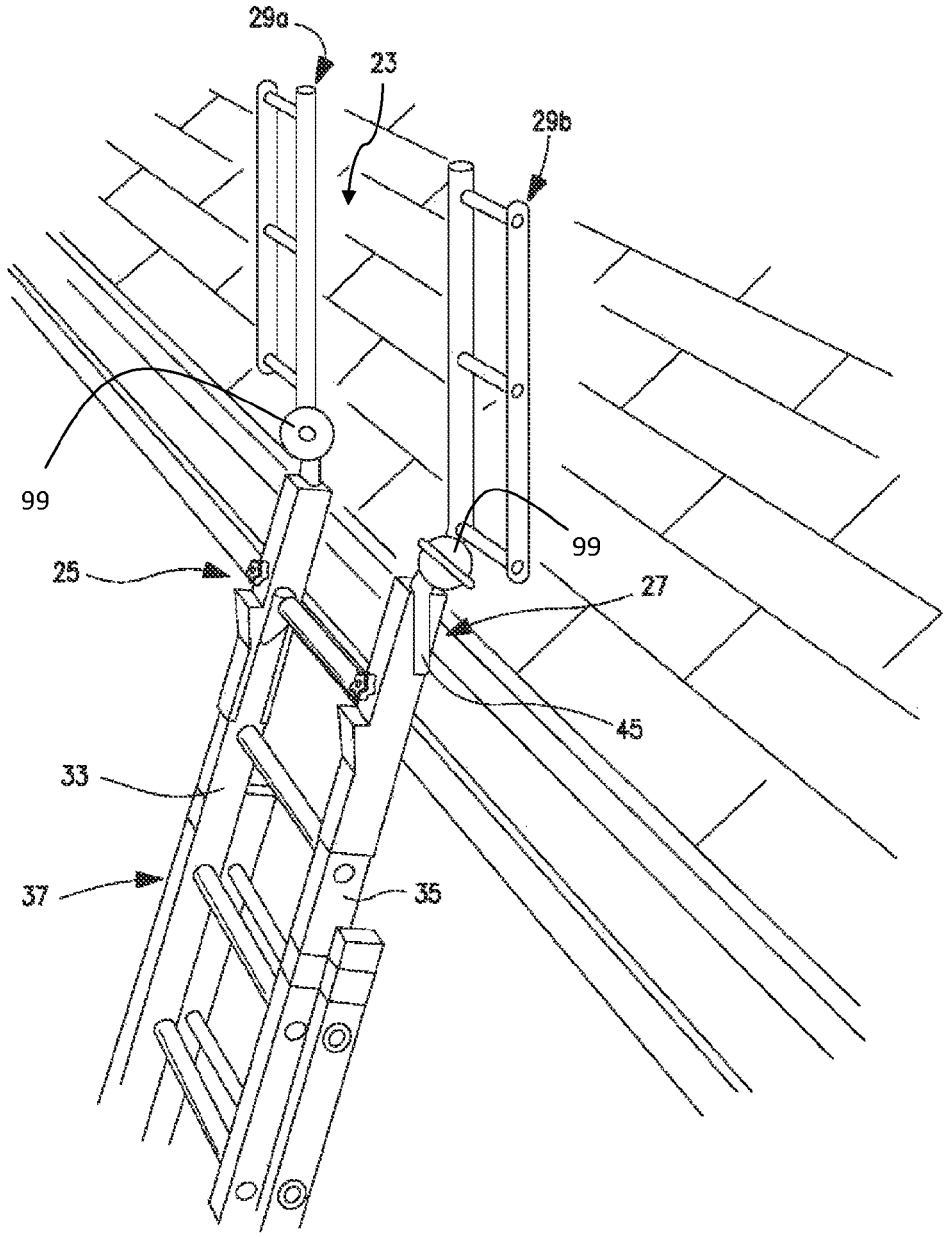
FIG. 2*a* is a partial perspective view with each member support pole having a releasable hinge.
Figure 2B:
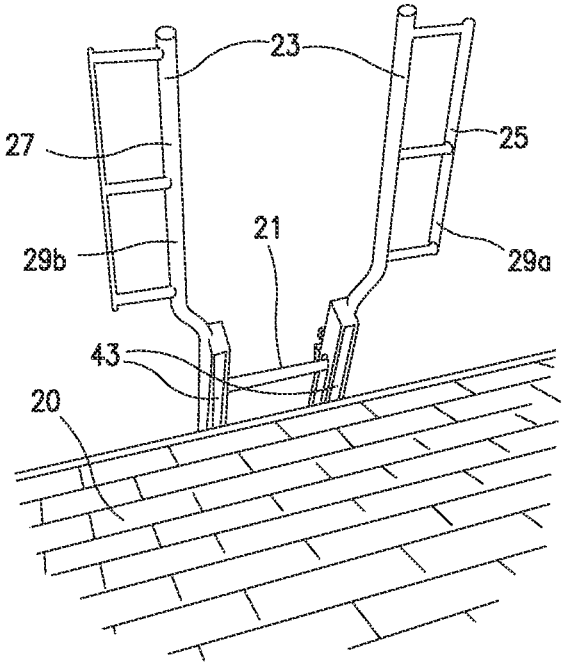
FIG. 2*b* is a partial rear perspective view showing the extension ladder and safety device of FIG. 1.
Figure 2C:
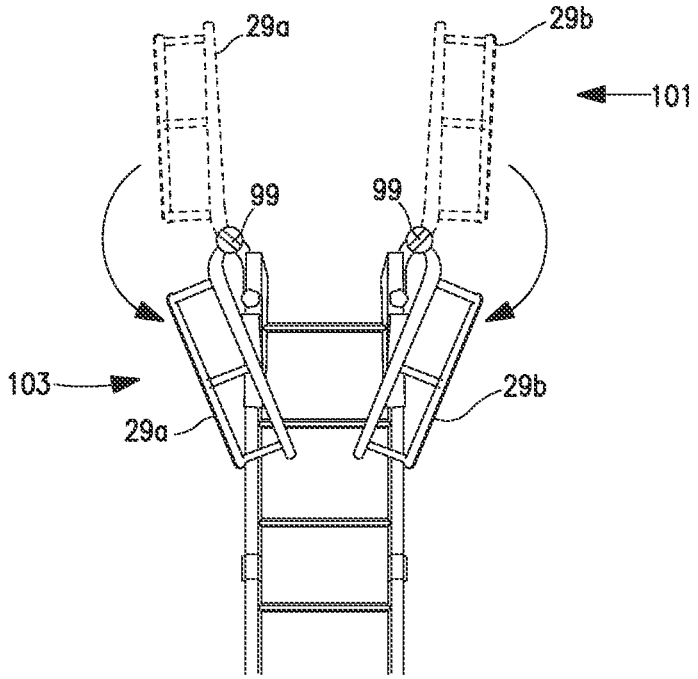
FIG. 2*c* is a climber's face view of a foldable safety device in the upright position and folded position.

In another embodiment of the present invention, the safety device is formed integrally with the ladder, such that the support poles are mounted permanently on the upper ends of the ladder, or are formed integrally therewith (not shown). The support poles 45 can be fitted with a releasable hinge 99, such as depicted in FIG. 2*a*, which permits the upper end of each safety device member 25, 27 to fold down on itself and onto the ladder 21. Examples of releasable ladder hinges which can be employed are disclosed for example in U.S. Pat. Nos. 4,407,045, 4,666,150, 7,093,311, and 7,306,075, each incorporated herein by reference. Depending upon where the hinge 99 is positioned, the length of the safety device members 25, 27 to folded back can be about 28 to 34 inches. The safety device members 25, 27 can be folded back when the ladder 21 is laid on the ground. The folded members permit the ladder 21 to be moved about more easily and stored in a workshop, or loaded on a rack mounted on a work truck more easily. The hinges 99 can be positioned so that the member handhold frameworks 29*a*, 29*b* also swing onto the ladder 21, such as depicted in FIG. 2*b*. FIG. 2*b* shows the frameworks 29*a*, 29*b* in the extended position 101 (shown in phantom) and swung into the folded position 103.

Figure 3:
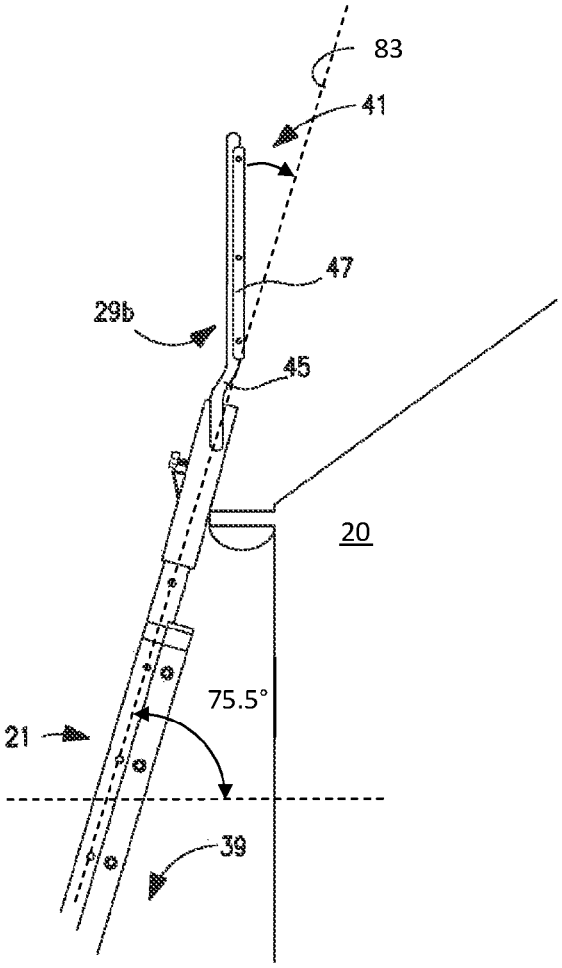
FIG. 3 is a partial side view of the ladder of FIG. 2.

It is suggested for safe operation to set an extension ladder 21 at the OSHA recommended parameters. The extension ladder 21 with the safety device 23 mounted thereupon is preferably set to lean against a building or wall at an angle from horizontal of 75.5 degrees, as shown in the partial side view of FIG. 3. To have the handhold frameworks 29*a*, 29*b* extend completely vertically upright when the ladder is at 75.5 degrees, the frameworks 29*a*, 29*b* are canted (angled) upward at an angle of about 15 degrees 41 (preferably 14.5 degrees) from the longitudinal axis 83 of the ladder 21. Each framework 29*a*, 29*b* is held outboard of the ladder side rails 33, 35 and beyond the top end of the ladder extension section 37 by a support tube or pole 45 (best seen in FIG. 2). This support pole 45 forms the inside member of each framework 29*a*, 29*b* from which each of the handhold bars 31 extend. The outboard ends of each handhold bar 31 are attached to a flat outside support bar 47. When the ladder 21 is properly positioned, each of the handhold grab bars 31 extends horizontally providing an optimal horizontal handhold.

Figure 4:
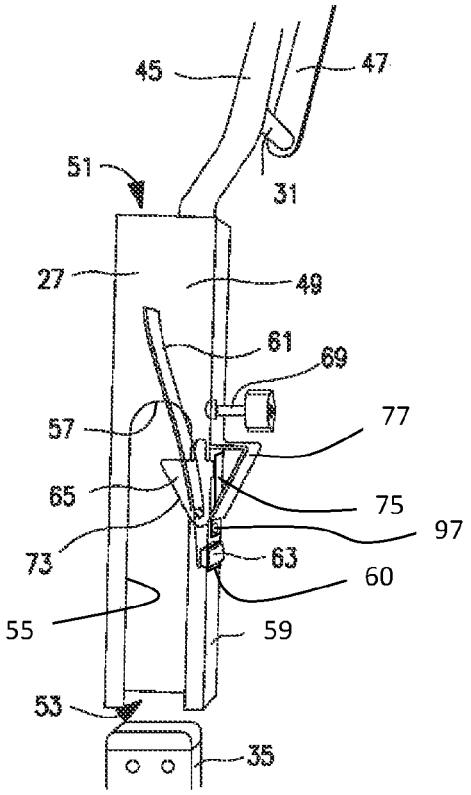
FIG. 4 is a partial side view of the right-hand member of the safety device of the present invention about to be installed on the upper end of an extension ladder.
Figure 5:
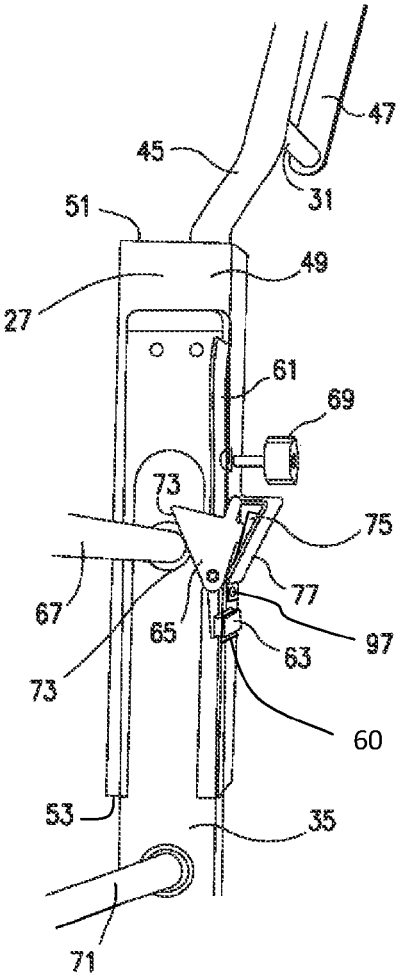
FIG. 5 is a view of the member of FIG. 4 with the right-hand member moved downwardly on the ladder side rail, wherein the rung pivot lock is being rotated by the top rung to remove the interference function of the pivot lock.
Figure 6:
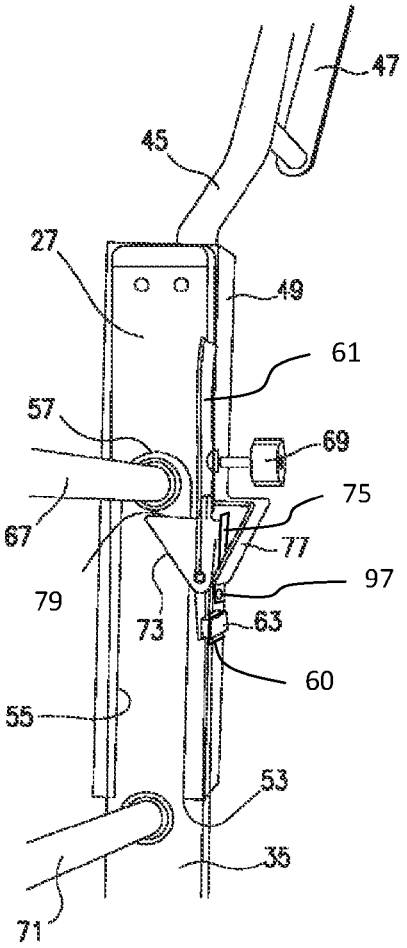
FIG. 6 is a view of the right-hand member of FIGS. 4 and 5 with the member being fully down so that the top rung abuts the top of the slot and the pivot lock has returned to is original position in an interference orientation with the top rung.
Figure 10:
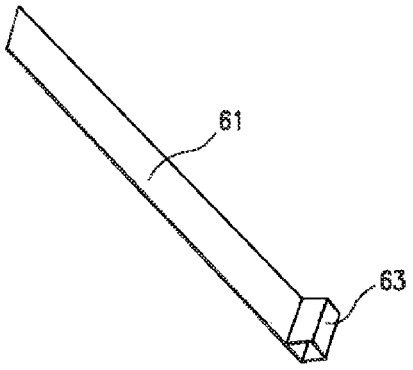
FIG. 10 is a perspective view of the securing tab plate.

Each member 25, 27 preferably includes a respective tubular, generally rectangular, sleeve 49, as shown for the right-hand member 27 in FIGS. 4-6. This sleeve 49 has a closed outer top end 51 and an open bottom end 53 to slide over the respective side rail 35 of the extension ladder 21. A slot 55 is formed on the inside face of the sleeve 49 (best seen in FIGS. 4 and 5) to extend from the open bottom 53 and to terminate in the upper half of the sleeve 49 in a curved surface 57. The curved surface 57 is adapted to rest upon ladder rungs having a generally circular cross-section. However, the shape of the surface 57 may be, for example, rectangular, to rest upon extension ladders having rungs with rectangular cross-sections (not shown). Preferably, positioned inside the sleeve 49 is an elongate securing tab plate 61 (best seen in FIGS. 4 and 10) held to a generally rectangular slot 60 in the adjacent wall 59 by a shoe 63 formed at one end of the securing tab plate 61. A rung pivot lock 65 is preferably pivotally connected to the slotted side of the sleeve 49. FIG. 4 is a partial perspective view showing the right-hand member 27 positioned just above and coaxial with the right side rail 35 of the ladder extension end 37 in preparation for slipping the right-hand member 27 over the right side rail 35 of the ladder extension end 37.

FIG. 5 is a side view showing the sleeve 49 partially mounted over the ladder extension end 37 of the side rail 35 of the extension ladder 21, the top rung 67 of the ladder extension end 37 has passed almost to the top of the slot 55 and the side rail 35 almost abuts the closed top 51. In this position, the side rail 35 has pushed the securing tab plate 61 back against the inside of the sleeve 49. Preferably, a knob-operated manual turn screw 69 extends through the wall of the sleeve 49 to bear against the securing tab plate 61 which in turn clamps against the side rail 35 when secured by an operator, the screw 69 preferably being peened to prevent inadvertent removal from the safety device 23.

The second rung 71 is preferably positioned below the open bottom end 53 of the sleeve 49. In moving the sleeve 49 onto the side rail 35 the top rung 67 engages the rung pivot lock 65 (best seen in the perspective view of FIG. 11) which is preferably triangularly shaped to provide a tapered camming surface 73 which operates against the top rung 67 to pivot the lock 65 out of the way of the top rung 67. The lock 65 is biased to an interference position by a spring plate 75 which is covered by a ramp-shaped locking tab cover plate 77, best seen in FIGS. 5, 12 and 13.

When the sleeve 49 is fully inserted over the side rail 35, as can be seen in FIG. 6, the top rung 67 is seated against the curved surface 57 at the top of the slot 55 and the second rung 71 is adjacent the open bottom 53 of the sleeve. The rung pivot lock 65 has rotated to its original rung interference position where, if the sleeve 49 is attempted to be moved outward off of the side rail 35, the abutment surface 79 of the rung pivot lock 65 engages the top rung 67 and stops the movement.

Figure 8:
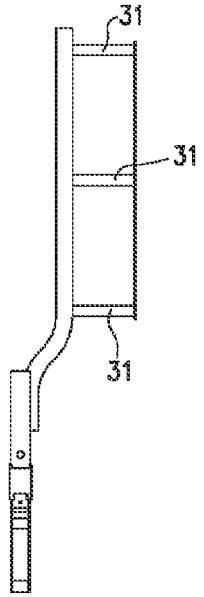
FIG. 8 is a front view of the sleeve and handhold framework of FIG. 7.
Figure 9:
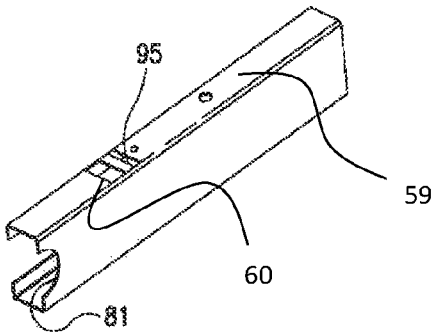
FIG. 9 is a perspective view of the right-hand member sleeve.

Preferably, as best seen in the front elevation view of FIG. 8 showing the right-hand member 27 the handhold bar frameworks 29*a*, 29*b*, preferably have handhold bars 31 spaced on 12 inch centers, as are the rungs of the ladder 21. The side elevation view of the right-hand member of FIG. 7 and the perspective view of the right-hand sleeve of FIG. 9 show that the opposite side of the sleeve 49 from the slotted side can have a half-circle cutout 81 at the open bottom 53. This cutout accommodates the second rung 71 where the spacing between rungs may vary. In so accommodating the second rung 71 the abutment of the top rung 67 against the top of the slot 55 is assured.

FIG. 9 also shows a rectangular cutout opening 60 in the slot adjacent sidewall 59. This opening 60 accommodates the shoe 63 at the one end of the securing tab plate 61, FIG. 10, in a friction fit.

Figure 11:
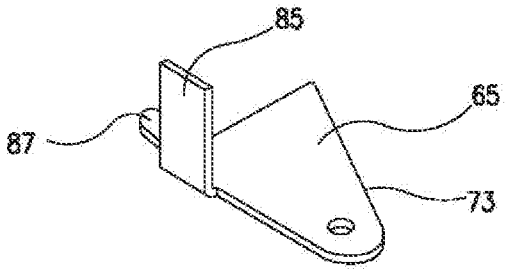
FIG. 11 is a perspective view of a rung pivot lock for the right-hand member of FIG. 5.

The rung pivot lock 65, FIG. 11, has two outwardly extending tabs, a first tab 85 extending perpendicular to the plane of the lock to extend under the lock tab cover plate 77 to engage the spring plate 75. This spring plate 75 biases the lock 65 to the original interference position. The second tab 87 assures that the lock does not bind and is useful for when manually moving the lock to a non-interference position.

Figure 12:
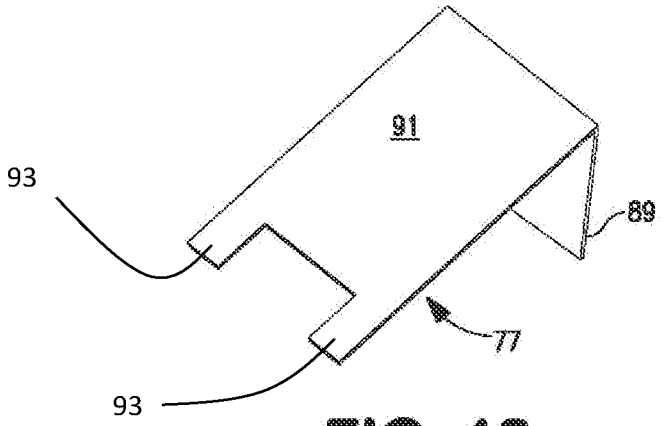
FIG. 12 is a perspective view of the locking tab cover plate.
Figure 13:
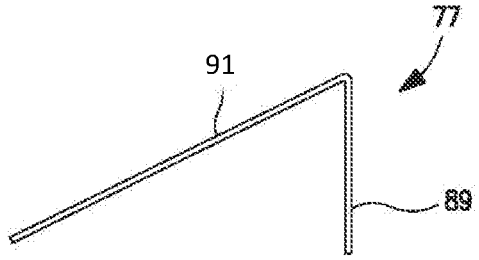
FIG. 13 is a side view of the locking tab cover plate of FIG. 12.

The lock tab cover plate 77, FIGS. 12, 13, has an upright wall 89 and a sloped top wall 91 supported on one end by the upright wall 89. The other end of the sloped wall 91 terminates in a pair of rectangular tabs 93. These tabs 93 engage a smaller rectangular slot 95 adjacent the opening 60 in the sleeve wall, FIG. 9. A bolt 97, FIG. 5, can secure the tabbed end of the cover 77 to the sleeve 49.

Figure 14:
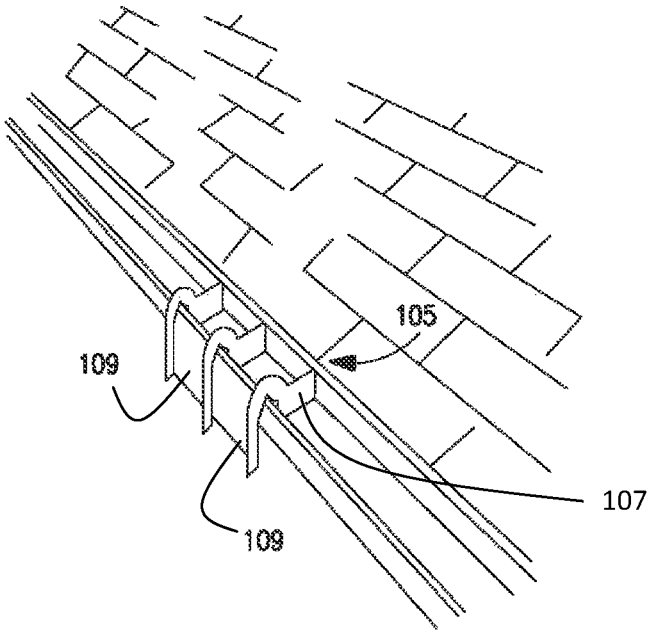
FIG. 14 PRIOR ART
FIG. 14 is a perspective view of a gutter shoe ladder support.
Figure 15:
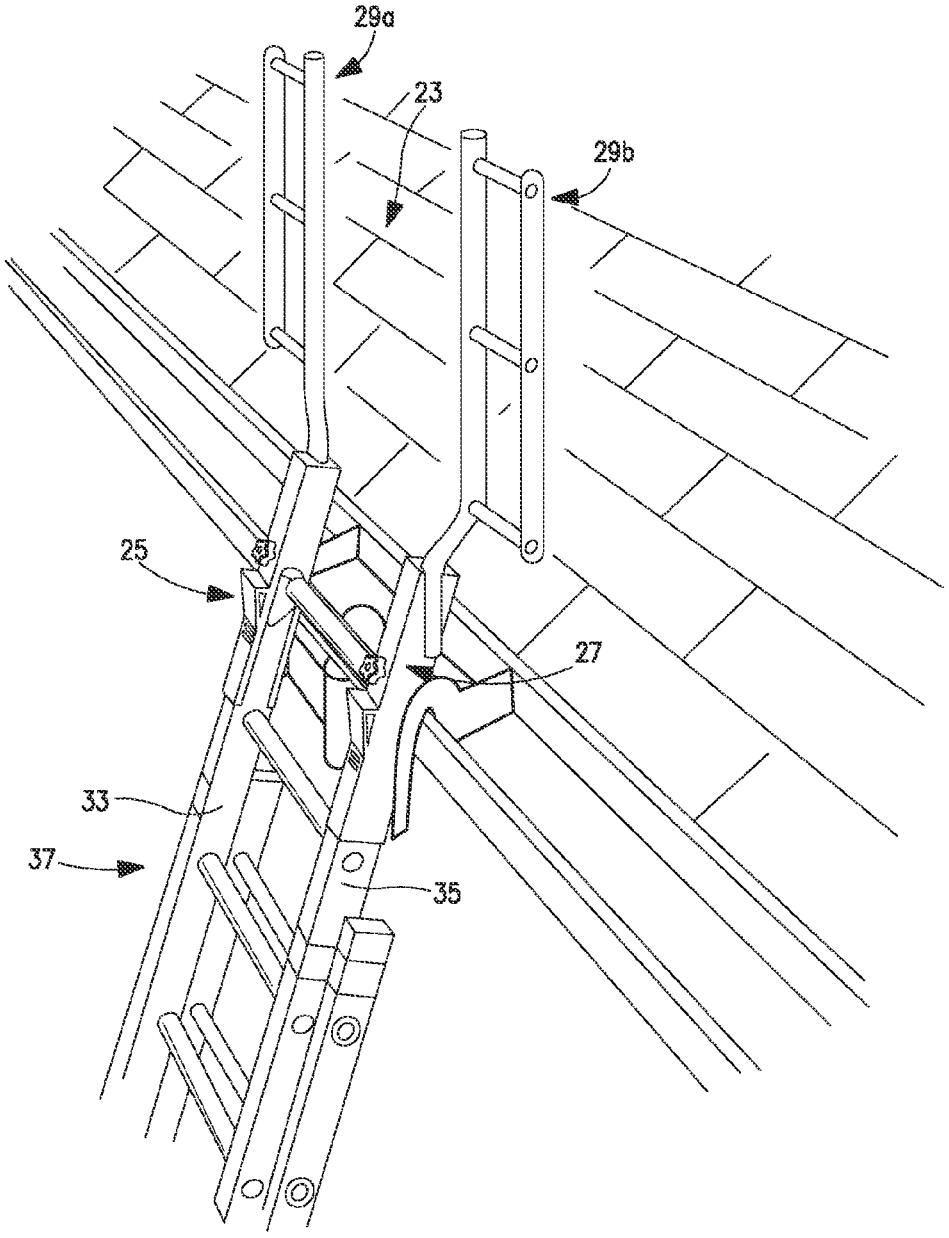
FIG. 15 is a perspective view of the safety device and ladder of FIG. 2 at rest against the gutter shoe of FIG. 14.

A gutter docking station 105, FIG. 14, (Roofer's World, Ottawa, Ont.), has a box-shaped structure 107 which fits inside of a building's gutter, and has a pair of channels 109 which extend over and downward on the outside face of the gutter. These two channels 109 receive the respective side rails 33, 35 of a ladder 21, or when the safety device is installed on the ladder 21, the channels receive the safety device members 25, 27, FIG. 15, and resist the ladder sideways movements.

In another embodiment of the present invention, the safety device is integrally formed with, or permanently attached to, a ladder, rather than being detachable (not shown).

Figure 16:
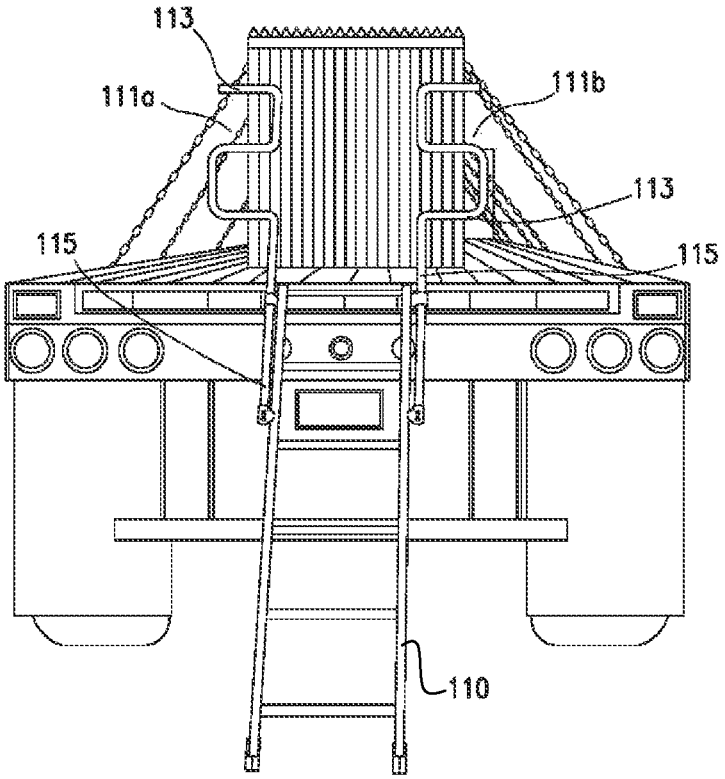
FIG. 16 is a climbers face view of a ladder with an alternate embodiment being a "zigzag" shaped grab bar safety device.
Figure 17:
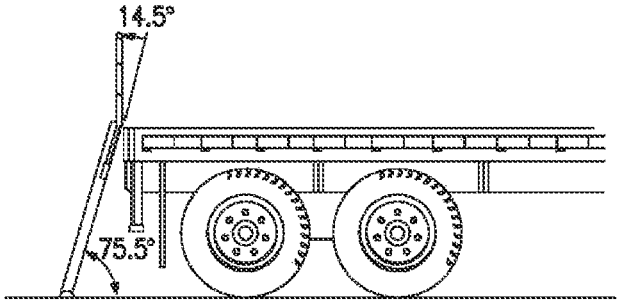
FIG. 17 is a side view of the ladder and safety device of FIG. 16.
Figure 19:
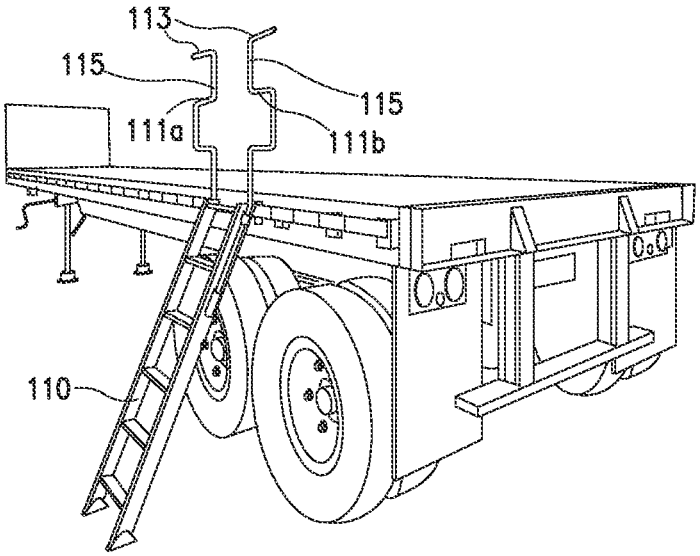
FIG. 19 is a perspective view of the ladder and safety device of FIG. 16 showing the ladder and safety device positioned on the side of a truck trailer.

In a further embodiment, FIGS. 16 and 17, a ladder 110 has the rectangular shaped grab bar frameworks 29*a*, 29*b*, replaced with "zigzag" shaped grab bar sections 111*a* and 111*b*. Each grab bar section 111*a* and 111*b* has three horizontal handholds 113 supported by a support pole 115. The support pole or tube 115 is mounted outside of the ladder 110 side rails so that the handholds 113 are outside of the line of ladder permitting a walk-through passage. This support pole 115 need bend only one direction so that the grab bar sections 111*a*, 111*b* are upright (vertical) when the ladder is at the proper angle when resting against a truck, FIG. 17. Advantageously, the ladder 110 can be positioned to rest against the truck trailer, such as shown in FIG. 19. When a truck trailer is being loaded, tie-down straps must typically be thrown over the load from the first side upon which they are fastened to the truck body to the opposite side, and the ends must be grasped at elevation typically about eight feet above the ground. Similarly, when tarps are used to cover a load, "bungee" cords are often employed to fasten to eyelets provided in the tarp to secure the tarp to the truck body, and the tarp edges often cannot be grasped without standing on a ladder.

Figure 21:
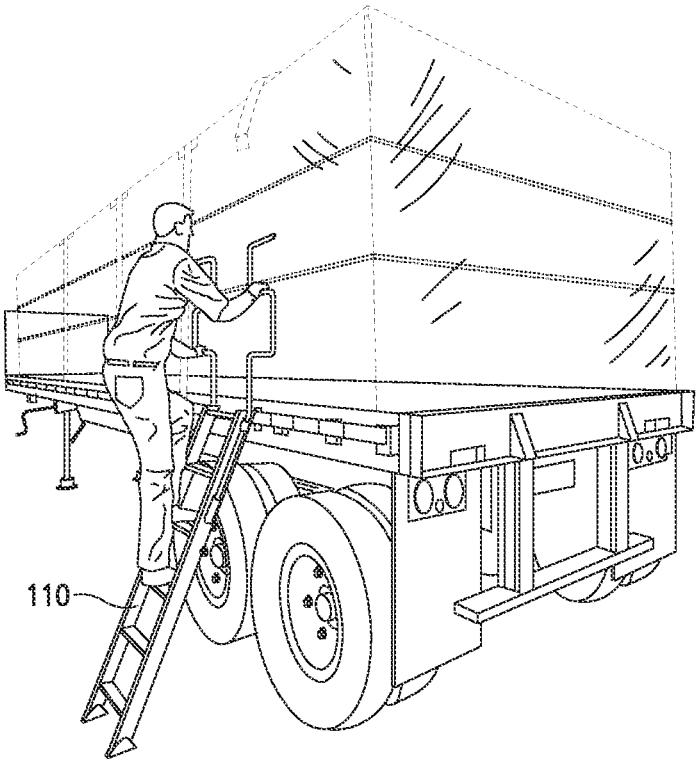
FIG. 21 is a perspective view of the safety device and truck trailer of FIG. 19, showing the trailer with a load being secured by an operator using the safety device to access straps to secure the load to the trailer.

FIG. 21 provides a perspective view of the safety device and truck trailer of FIG. 19, showing the trailer with a load being secured by an operator using the safety device to access straps to secure the load to the trailer. Conventional straight ladders employed to reach and grasp the tie-down straps may have to be placed against the load rather than the truck body, a less secure practice than employing a ladder according to the present invention.

Figure 18:
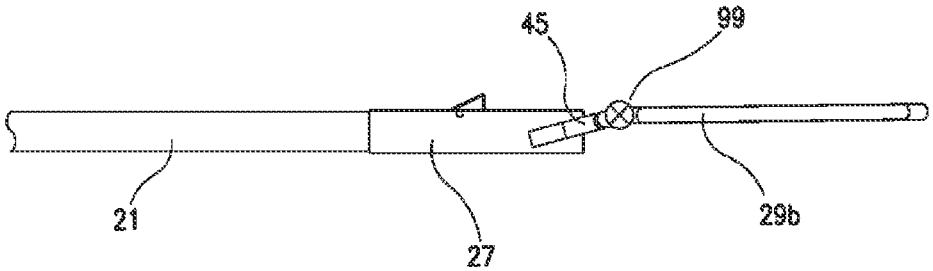
FIG. 18 is a side view of the ladder of FIG. 16 with an alternate embodiment being a releasable hinge which permits the grab bar safety device to fold forward.

If the hinge 99 is further adjusted, the grab bar sections 29*a*, 29*b* or 111*a*, and 111*b*, can be folded approximately in alignment with the ladder 21 (or ladder 110), as shown in FIG. 18. The folding scheme works better with shorter ladders and it extends the length needed to carry or store the ladder.

Many changes can be made in the above-described invention without departing from the intent and scope thereof. it is therefore intended that the above description be read in the illustrative sense and not in the limiting sense. Substitutions and changes can be made while still being within the scope and intent of the invention and of the appended claims.

The invention claimed is:

1. A walk-through safety device configured to be used with a ladder having side rails and rungs including a top rung, each of said side rails respectively having a top end, and the ladder having a major longitudinal axis, the safety device comprising:

right and left complementary members, each of said members being mountable to and removable from a respective one of the top ends of a respective one of said side rails of the ladder, each of said members respectively comprising:

a box tube sleeve configured to extend over the respective one of the side rails from the respective one of the top ends to below the top rung of the ladder, said box tube sleeve having sidewalls and an outside surface, the sidewalls including an inside wall;

a support post having a lower section and an upper section, the lower section of the support post being attached to the outside of the box tube sleeve and extending, when the safety device is mounted on the ladder during use, in a lateral outward direction from the ladder and above a height of the top ends, a major length of the upper section of the support post extending substantially vertically when the safety device is mounted on the ladder as the ladder rests against a structure so that the major longitudinal axis of the ladder is at a predefined angle of about 75.5 degrees with respect to horizontal, a major length of said support post being canted relative to the major longitudinal axis of the ladder at an angle of about 14.5 degrees;

a framework of plural handhold bars sequentially positioned, the framework presenting a vertical extension when the safety device is mounted on the ladder and the ladder is at the predefined angle with respect to horizontal;

a manually operated screw configured to provide a clamping force between the box tube sleeve and the respective one of said side rails of the ladder;

a rung pivot lock operable to extend into an interference position with the top rung of the ladder prohibiting removal of the box tube sleeve from the respective one of the side rails when the safety device is mounted on the ladder;

the box tube sleeve including a dosed outside end, and a slot in the inside wall configured to receive the top rung when the safety device is mounted on the ladder, the slot having a dosed end, the slot enabling the box tube sleeve to slide by the top rung, wherein the respective one of the top ends abuts the dosed outside end of the box tube sleeve as the top rung abuts the dosed end of the slot when the safety device is mounted on the ladder;

a securing tab plate positioned inside the box tube sleeve;

the manually operated screw extending through one of said sidewalls of the box tube sleeve to engage the securing tab plate to move the securing tab plate into clamping engagement with the respective one of the side rails so that the respective one of the side rails and the box tube sleeve are clamped together when the safety device is mounted on the ladder;

wherein the rung pivot lock is attached to one of the sidewalls of the box tube sleeve and configured to pivot into and out of the interference position with the top rung when the safety device is being mounted onto and removed from the ladder respectively;

a spring plate attached to the box tube sleeve and configured to engage and bias the rung pivot lock into the interference position; and the rung pivot lock having a triangularly shaped flat plate having a first protruding tab and a second protruding tab, the triangularly shaped flat plate further defining a plane, the first protruding tab extending perpendicular to the plane of the triangularly shaped flat plate to engage the spring plate, and the second protruding tab extending in the plane of the triangularly shaped flat plate and being usable to manually move the rung pivot lock out of the interference position.

2. The safety device of claim 1, wherein the securing tab plate is an elongate bar with a box-shaped shoe at one end, and wherein the box tube sleeve has a rectangular opening in one of the sidewalls of the box tube sleeve adjacent the inside wall for receiving the securing tab plate shoe in a friction fit.

3. The safety device of claim 2, wherein the rung pivot lock and the spring plate are positioned adjacent to the outside surface of the box tube sleeve, and wherein the safety device also includes a locking tab cover plate fixed to the outside surface of the box tube sleeve over the spring plate and the first protruding tab of the rung pivot lock where the first protruding tab is configured to engage with the spring plate.

4. The safety device of claim 3, wherein the manually operated screw includes a knob for finger tightening and loosening of the manually operated screw and wherein the manually operated screw is secured from removal.

* * * * *